US006339743B1

(12) United States Patent
Young et al.

(10) Patent No.: US 6,339,743 B1
(45) Date of Patent: Jan. 15, 2002

(54) IGNITION SYSTEM AND METHOD OF PROGRAMMING AN IGNITION SYSTEM

(75) Inventors: Michael Young, Bowling Green, KY (US); Ronald D. Mackie, Pensacola, FL (US)

(73) Assignee: Holley Performance Products, Inc., Bowling Green, KY (US)

( * ) Notice: Subject to any disclaimer, the term of this patent is extended or adjusted under 35 U.S.C. 154(b) by 0 days.

(21) Appl. No.: 09/512,254

(22) Filed: Feb. 24, 2000

Related U.S. Application Data

(62) Division of application No. 09/209,933, filed on Oct. 30, 1998, now Pat. No. 6,205,395.

(60) Provisional application No. 60/063,974, filed on Oct. 31, 1997, provisional application No. 60/063,963, filed on Oct. 31, 1997, provisional application No. 60/063,962, filed on Oct. 31, 1997, provisional application No. 60/063,956, filed on Oct. 31, 1997, and provisional application No. 60/063,934, filed on Oct. 31, 1997.

(51) Int. Cl.[7] ..... G06G 7/70

(52) U.S. Cl. ..... 701/115

(58) Field of Search ..... 701/115, 114, 701/102, 101, 93, 29, 35; 123/406.64, 406.65, 406.57, 480; 364/191

(56) References Cited

U.S. PATENT DOCUMENTS

| | | | | |
|---|---|---|---|---|
| 3,904,856 A | * | 9/1975 | Monpetit | 701/101 |
| 3,926,165 A | | 12/1975 | Merrick | 123/636 |
| 3,934,566 A | | 1/1976 | Ward | 123/604 |
| 3,955,545 A | | 5/1976 | Priegel | 123/531 |
| 4,034,733 A | | 7/1977 | Noguchi et al. | 123/275 |
| 4,046,125 A | | 9/1977 | Mackie | 123/604 |

(List continued on next page.)

OTHER PUBLICATIONS

McFarland, Jim, "Performance Camshafts: Beyond the Basics," Hot Rod Magazine, 6 pages (11/98).
Bohacz, Ray T., "In and Out: Making Sense of cylinder–head flow testing," Hot Rod Magazine, pp. 66–80 (6/99).
Bohacz, Ray T., "10 things you always wanted to know about engines," Hot Rod Magazine, 6 pages (9/99).
McCoy, Charlie, "LSI Mojo—The OBD–II Computer Gets Hacked," Hot Rod Magazine, 4 pages (2/99).
Bohacz, Ray T., "Mechanical Equilibrium—The Art of Engine Balancing," Hot Rod Magazine, pp. 83–94 (5/99).
McFarland, Jim, "Engine–Cycle Analysis," Hot Rod Magazine, 4 pages (4/98).
Magnante, Steve, "Closed–loop TBI for hot–rodded engines," Hot Rod Magazines, 5 pages (12/98).
"MSD 7530 Fully Programmable Race Ignition", Product Features; Mar. 16, 1999; 18 pages.
"Basic Operation and Function of the MSD Pro Data Plus" 55 pages printout from web, undated.
HC916 Technical Summary—Motorola Literature Distribution, P.O. Box 20912, Phoenix, AZ 85036, Printed in USA in May 1996.

*Primary Examiner*—John Kwon
*Assistant Examiner*—Hieu T. Vo
(74) *Attorney, Agent, or Firm*—Hunton & Williams; Christopher C. Campbell

(57) ABSTRACT

An ignition system for energizing an ignition coil of an internal combustion engine. The system including a high voltage unit for energizing the ignition coil of the engine, a memory for storing system function indices and a processor. The processor receives a timing signal from an engine speed pick-up device, accesses the memory to retrieve the system function indices, and causes the high voltage unit to energize the ignition coil based on the system function indices and the frequency of the timing signal. The system also includes a programmer in communication with the processor for allowing a user to instruct the processor to select and modify the system function indices during engine operation.

22 Claims, 13 Drawing Sheets

U.S. PATENT DOCUMENTS 4,050,878 A 9/1977 Priegel ..... 431/90
4,052,967 A 10/1977 Colling et al. ..... 123/406.53
4,087,491 A 5/1978 Chapin ..... 261/36.2
4,089,215 A 5/1978 Chapin ..... 73/116
4,108,127 A 8/1978 Chapin et al. ..... 123/327
4,112,901 A 9/1978 Chapin et al. ..... 123/505
4,122,716 A 10/1978 Priegel ..... 73/116
4,131,100 A 12/1978 Merrick ..... 123/598
4,143,633 A 3/1979 Peck ..... 123/599
4,262,334 A 4/1981 Monpetit ..... 701/102
4,284,053 A 8/1981 Merrick ..... 123/497
4,326,493 A 4/1982 Merrick ..... 123/606
4,408,582 A 10/1983 Merrick ..... 123/406.46
4,408,583 A 10/1983 Merrick ..... 123/406.66
4,424,784 A 1/1984 Miller ..... 123/438
4,426,979 A 1/1984 Tung ..... 123/478
4,467,763 A 8/1984 Gillespie et al. ..... 73/116
4,510,420 A 4/1985 Sasso ..... 123/268
4,538,573 A 9/1985 Merrick ..... 123/406.5
4,538,586 A 9/1985 Miller ..... 123/620
4,558,673 A 12/1985 Mackie ..... 123/335
4,575,809 A 3/1986 Sinniger et al. ..... 701/115
4,578,755 A 3/1986 Quinn et al. ..... 701/99
4,596,215 A 6/1986 Palesotti ..... 318/37
4,620,521 A 11/1986 Henderson et al. .... 123/406.57
4,633,834 A 1/1987 Takeuchi et al. ..... 123/406.53
4,644,284 A 2/1987 Friedline et al. ..... 324/397
4,817,466 A * 4/1989 Kawamura et al. ..... 477/112
4,869,132 A 9/1989 Clem ..... 123/335
4,882,586 A * 11/1989 Dolph et al. ..... 341/169
4,885,573 A * 12/1989 Fry et al. ..... 340/519
5,004,984 A 4/1991 Becker et al. ..... 324/402
5,154,624 A 10/1992 Lemajeur et al. ..... 477/109
5,168,842 A 12/1992 Brooks ..... 439/130
5,208,540 A 5/1993 Hoeflich ..... 324/388
5,293,317 A 3/1994 Adrian et al. ..... 701/115
5,315,982 A 5/1994 Ward et al. ..... 123/634
5,431,134 A 7/1995 Budde et al. ..... 123/146.5 A
5,526,785 A 6/1996 Masters ..... 123/335
5,531,206 A 7/1996 Kitson et al. ..... 123/596
5,535,620 A 7/1996 Nichols ..... 73/118.1
5,608,632 A * 3/1997 White ..... 701/115
5,644,491 A 7/1997 Fiske et al. ..... 701/102
5,648,898 A * 7/1997 Moore-McKee et al. ... 364/191
5,803,043 A * 9/1998 Bayron et al. ..... 123/335
5,905,374 A * 5/1999 Westberg et al. ..... 324/160
5,982,168 A * 11/1999 Westberg et al. ..... 324/160
6,078,859 A * 6/2000 Jastrzebski et al. ..... 701/93
6,205,395 B1 * 3/2001 Young et al. ..... 701/115

* cited by examiner

IGNITION SYSTEM AND METHOD OF PROGRAMMING AN IGNITION SYSTEM

RELATED APPLICATIONS

This application claims priority from U.S. Provisional Patent Application Ser. Nos. 60/063,934, 60/063,956, 60/063,962, 60/063,963 and 60/063,974, all filed on Oct. 31, 1997, the disclosures of which are herein incorporated by reference in their entirities.

This application is a 37 C.F.R. § 1.53(b) divisional of Ser. No. 09/209,933 filed on Oct. 30, 1998, now U.S. Pat. 6,205,395 issued Mar 20, 2001.

BACKGROUND

The present disclosure relates, in general, to a system for controlling ignition timing in an internal combustion engine. Even more particularly, the present disclosure relates to an ignition system having a microcontroller and a programmer for changing values stored in the microcontroller.

In high performance combustion engine applications, such as drag racing, a capacitive discharge ignition system is often preferred because a capacitive discharge ignition system is fast and efficient at providing energy for creating sparks, especially at high speeds. A capacitive discharge ignition system uses a storage, or "bathtub," capacitor to hold energy until the correct time to make the spark. The capacitor is connected to an ignition coil of the engine through a switch such that, to generate a spark, the switch is activated to dump the charge from the capacitor to a primary side of the ignition coil in less than 1/10th of a millionth of a second. The charge from the capacitor is then stepped up by the turns ratio of the ignition coil and applied to spark plugs of the engine for igniting fuel within combustion chambers of the engine.

The capacitor can be charged extremely fast and can hold energy for extended periods, with almost no loss or leakage, and then can release the energy to the ignition coil very quickly. Thus, a capacitive discharge ignition system provides an extremely fast and efficient method of storing and distributing energy to create sparks in an engine, with no drop off in engine performance at high speeds.

However, the quicker, hotter sparks of a capacitive discharge ignition system results in a shorter duration for each spark, which can disrupt engine performance at low speeds. At high engine speeds, a shorter duration spark is not a problem since the spark is supposed to occur very quickly. But at low engine speeds, the shorter duration sparks can result in poor performance because cylinder pressures and temperatures are low and air/fudel mixtures can be less than optimal. Thus, it is preferable that a capacitive discharge ignition system automatically provide multiple sparking, or "restrikes," at low engine speeds to ensure excellent engine performance.

A capacitive discharge engine will preferably also include an engine speed, or rev, limiter feature to protect the engine from dangerous high speeds, or "over-revving," wherein the engine could be damaged or even explode. A rev limiter feature turns off the spark to individual cylinders of the engine when engine speed exceeds a preset maximun level. Thus, the engine is purposely caused to misfire so that the engine speed is brought back down to the preset maximum level.

In addition a digital ignition system is preferable to an analog ignition system since a digital ignition system is generally not effected by temperature and humidity and, thus, provides more accurate and consistent engine performance. A digital ignition system utilizes a microcontroller, which includes a central processing unit and memory, for controlling system functions such as restrikes, rev limiters, engine speed activated switches, spark duration, and ignition timing. Because a microcontroller is not effected by temperature and humidity, like the resistors of an analog system, a digital ignition system utilizing a microcontroller is simply more accurate and consistent and, therefore, preferred. A digital system also provides greater flexibility and convenience.

Furthermore, all features of an ignition system, such as restrikes, rev limiters, engine speed activated switches, spark timing retards and timing curves, will preferably be provided in an integrated package such that add-on boxes and other additional components are not necessary and do not have to be added to the ignition system once installed in a vehicle.

Most importantly, a preferred ignition system will include means for instantaneously, and remotely, programming system function values. By instantaneously and remotely, it is meant that the ignition system should allow a user to be seated in a driver's compartment of a vehicle incorporating the ignition system, while the vehicle is positioned at a starting line at the beginning of a race, with the engine either running or turned off, to instantaneously change system settings.

Accordingly, what is still needed is a digital capacitive discharge ignition system that provides numerous features such as multiple sparks and over rev protection, wherein all features are provided in a fully integrated package, and wherein the ignition system includes means for instantaneously and remotely programming system function values.

SUMMARY

The present diclosure, therefore, provides an ignition system for energizing an ignition coil of an internal combustion engine. The system including a high voltage unit for energizing the ignition coil of the engine, a memory for storing system function indices and a processor. The processor receives a timing signal from an engine speed pick-up device, accesses the memory to retrieve the system function indices, and causes the high voltage unit to energize the ignition coil based on the system function indices and the frequency of the timing signal. The system also includes a programmer in communication with the processor for allowing a user to instruct the processor to select and modify the system function indices during engine operation.

Another ignition system for energizing an ignition coil of an internal combustion engine is also disclosed. The system includes a high voltage unit for energizing the ignition coil of the engine, a memory for storing a system function index, and a processor. The processor receives a timing signal from an engine speed pick-up device, accesses the memory to retrieve the system function index, and causes the high voltage unit to energize the ignition coil based on the system function index and the frequency of the timing signal. The system also includes an input device having a microcontroller for converting user inputs into a value for the system function index, communicating the value to the processor, and instructing the processor to insert the value into the system function index.

A process for changing values stored in function indices within an ignition system microcontroller in response to user inputs through a remote programmer having function, value and scroll switches and a display is also disclosed. The function indices are accessed by the ignition system to calculate ignition timing. The process includes monitoring the function and the value switches of the programmer, displaying a function code if the function switch is selected, displaying a different function code if the scroll switch is selected, displaying a value for a last displayed function code if the value switch is selected, and displaying a different value for the last displayed function code if the scroll switch is selected. The process also includes saving a last displayed value of the last displayed function code into a random access memory of the microcontroller. The last displayed value of the last displayed function code is then saved in a system function index corresponding to the last displayed function code if the function switch is selected. The system function index is located within programmable read-only memory of the microprocessor accessed by the ignition system to calculate ignition timing.

Another process for changing values stored in function indices within an ignition system microcontroller in response to user inputs through an input device having a switch and first and second indicators is disclosed. The function indices are accessed by the ignition system to calculate ignition timing. The process includes scanning the switch, accessing an index of a random access memory to retrieve an old value of the switch stored in the index of the random access memory, comparing a scanned value of the switch to the old value of the switch, turning on the first indicator if the scanned value and the old value are not equal, and causing the scanned value to be stored in the system function index of the programmable read only memory. The process also includes replacing the old value with the scanned value of the switch in the index of the random access memory, and turning on the second indicator and turning off the first indicator.

Still other features and advantages will become apparent upon reading the following detailed description in conjunction with the drawings and the appended claims.

BRIEF DESCRIPTION OF THE DRAWINGS

So that those having ordinay skill in the art to which this disclosure appertains will more readily understand how to construct an ignition system in accordance with this disclosure, the ignition system will be described in detail hereinbelow with reference to the drawings wherein.

DETAILED DESCRIPTION

Figure 1:
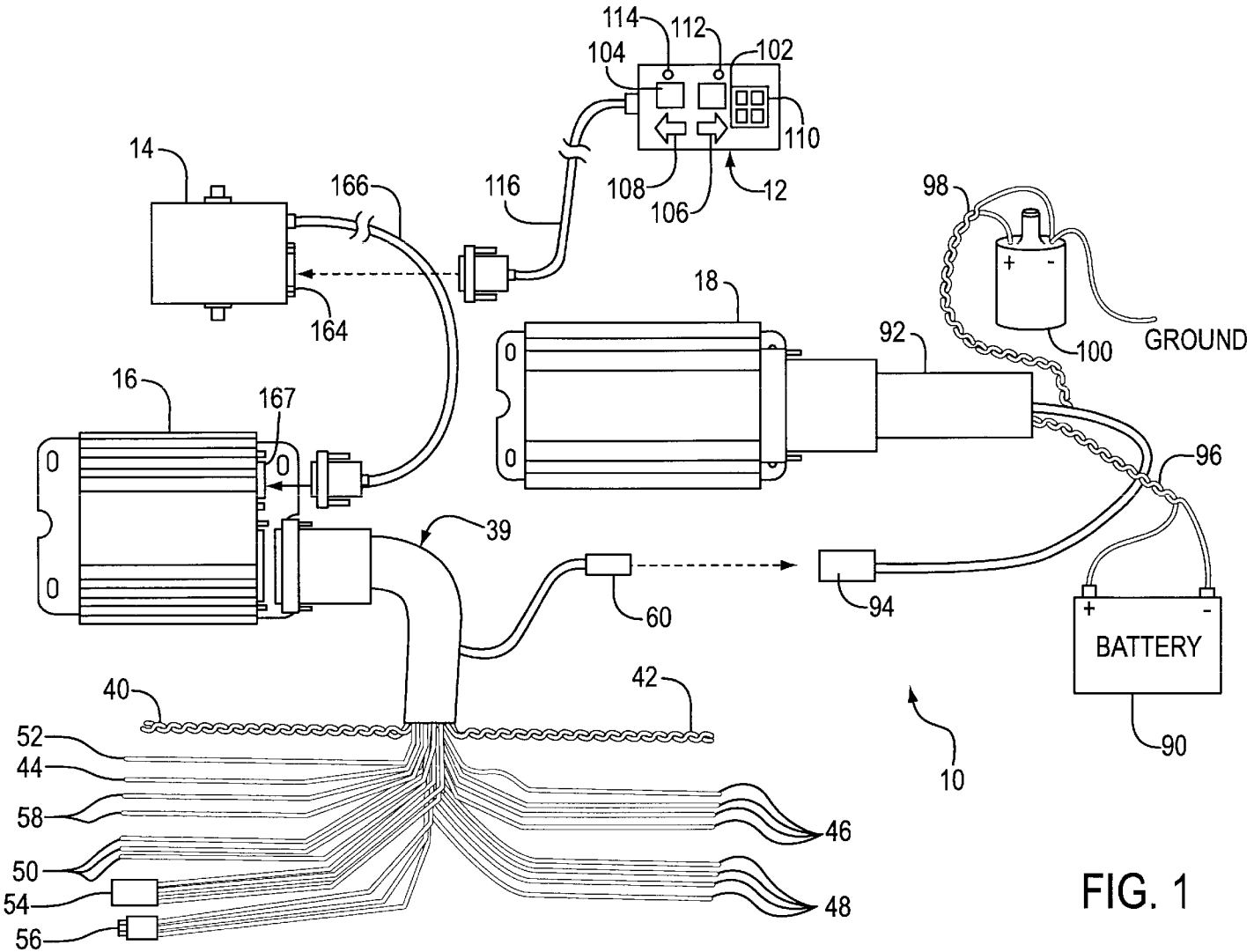
FIG. 1 shows a top plan view of the presently disclosed ignition system.

Referring to FIG. 1, an ignition system 10 according to the present disclosure is shown. In general, the system is a filly integrated, digital, high-performance, multi-spark, capacitive discharge ignition system, wherein system default values used to calculate ignition timing can be changed through a remote programmer 12 and/or a "starting line" rev limiter input device 14.

The presently disclosed ignition system 10 includes, in addition to the remote programmer 12 and the rev limiter input device 14, a control module 16 and a high voltage 18 unit. The ignition system 10 provides a plurality of integrated features, most of which are user-programmable.

System Features

Features of the presently disclosed ignition system 10 include: multiple sparking at low engine speeds; main, staging, burnout and auxiliary engine speed limiters ("rev limiters") having user-programmable values; a choice of two misfire patterns for each of the rev limiters; user-programmable timing retards; user-programmable engine speed activated switches ("RPM switches"); a user-programmable timing curve; and a tachometer output. These features are controlled by a microcontroller 20, and user-programmable values associated with the features are quickly and easily changed via the programmer 12 and/or the rev limiter input device 14. All features are described in detail in the 1998 Holley® Performance Products Catalog available from Holley Performance Products of Bowling Green, Ky., which is incorporated herein by reference.

As is known, multiple sparks in a capacitive discharge ignition system are necessary at lower engine speeds in high performance engines, to produce longer overall spark duration. The present ignition system 10 provides multiple sparks at low engine speeds, i.e., preferably below 3,000 revolutions per minute (rpm). Once above 3,000 rpm, however, the ignition system generally provides one spark per cylinder per crankshaft revolution. The multiple sparking at low engine speed feature of the presently disclosed system 10 is automatic and not user-programmable. U.S. Pat. Nos. 4,046,125 and 4,558,673 to Mackie (an inventor of the present ignition system) disclose capacitive discharge ignition systems that provide multiple sparks at lower engine speeds, and are herein incorporated by reference in their entirities.

The rev limiting feature is used to prevent engine damage by limiting the engine 1o a programmable maximum speed such that the engine does not "over rev". The main, burnout, staging, and auxiliary rev limiters have user-programmable over rev values. In addition, the burnout, staging, and auxiliary rev limiters are activated or enabled by external switches, such as a line lock, trans brake, delay box or timer. When the over rev value for any of the rev limiters is achieved (and, in the case of the burnout, staging, and auxiliary rev limiter, if the rev limiter has been enabled by an external switch), the microcontroller 20 prevents sparking in some of the cylinders, purposely causing the engine to misfire and thereby preventing engine speed from rising above the over rev value. For each of the four types of rev limiters, the microcontroller 20 can be programmed for a random or a sequential misfire pattern.

The timing retard feature retards ignition timing to improve engine performance. The system 10 includes four timing retards, each user-programmable from 0–20° spark timing in 1° increments, and enabled by remote switches. The system 10 also has a boost retard feature which can be turned on or off by a user through the programmer 12. When turned on, the boost retard feature adds 1° of timing retard for each pound of boost pressures detected in a manifold of the engine. The use of the boost retard feature requires a manifold pressure ("MAP") sensor, which the system is pre-wired for.

The RPM switches are activated at user-programmable engine speeds for turning on or controlling remote, auxiliary engine components, accessories or indicators, such as a shift light or an air shifter. An "activation" engine speed for each switch is user-programmable preferably from 0 rpm to 16,000 rpm in 100 rpm increments. The switch is activated when the engine reaches the user programmed activation speed. A "deactivation" engine speed for each switch is also user-programmable preferably from 0 rpm to 16,000 rpm in 100 rpm increments, such that the switch will be deactivated when engine speed falls below the user selected deactivation speed.

The present ignition system 10 also includes a user-programmable timing curve, wherein the exact amount of timing advance or retard can be programmed at each of a plurality of timing points. For example, the system preferably allows a 32 point timing curve from zero to fifty degrees (in one degree increments) from 500 rpm to 16,000 rpm (in 500 rpm increments). A user, therefore, is quickly and easily allowed to create an infinite number of timing curves using the remote programnmer 12. In addition, the system automatically provide a linear connection between adjacent points.

Control Module and High Voltage Unit

Figure 2:
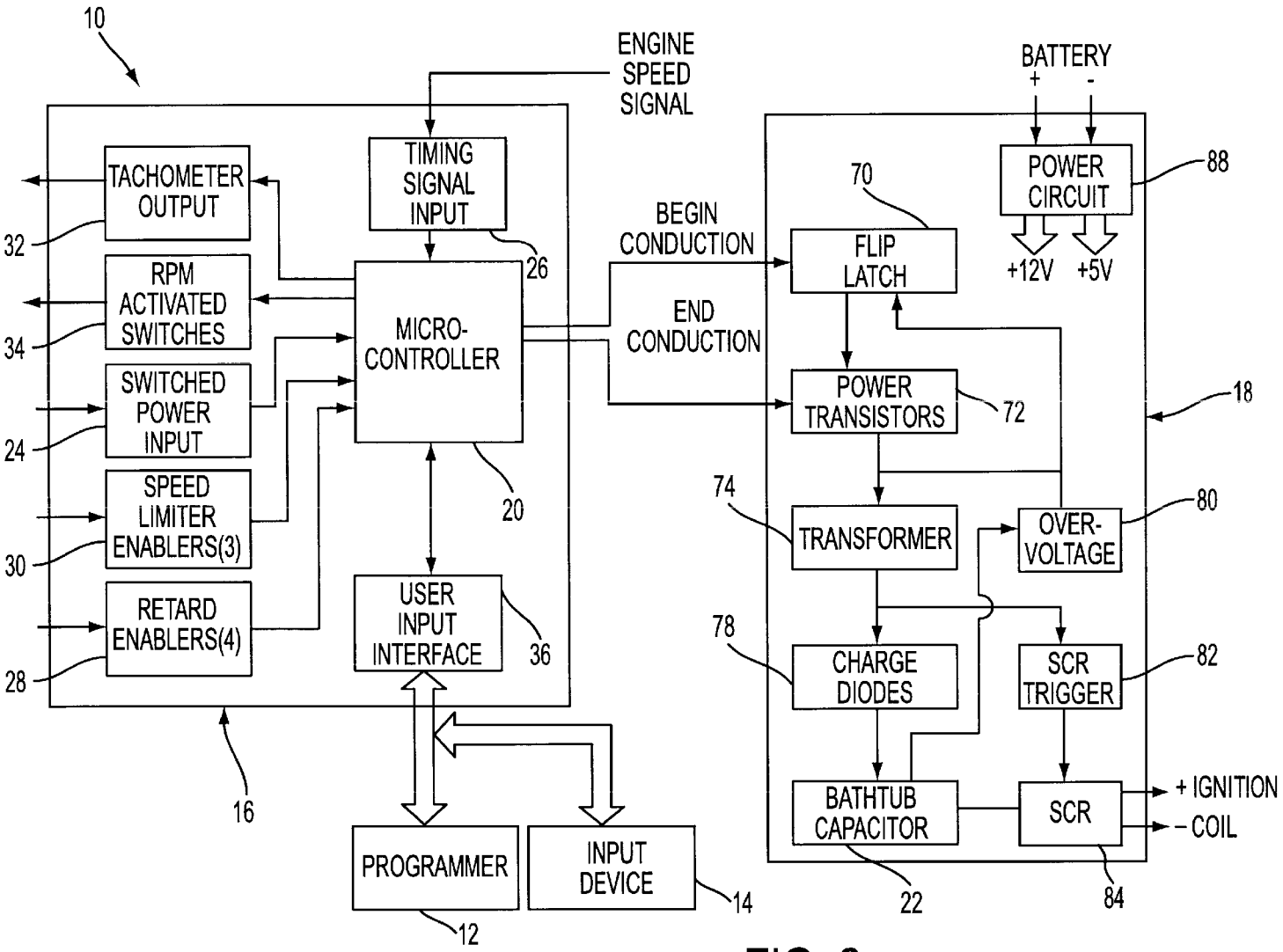
FIG. 2 shows a hardware block diagram of a control module and a high voltage module of the ignition system of FIG. 1.
Figure 3:
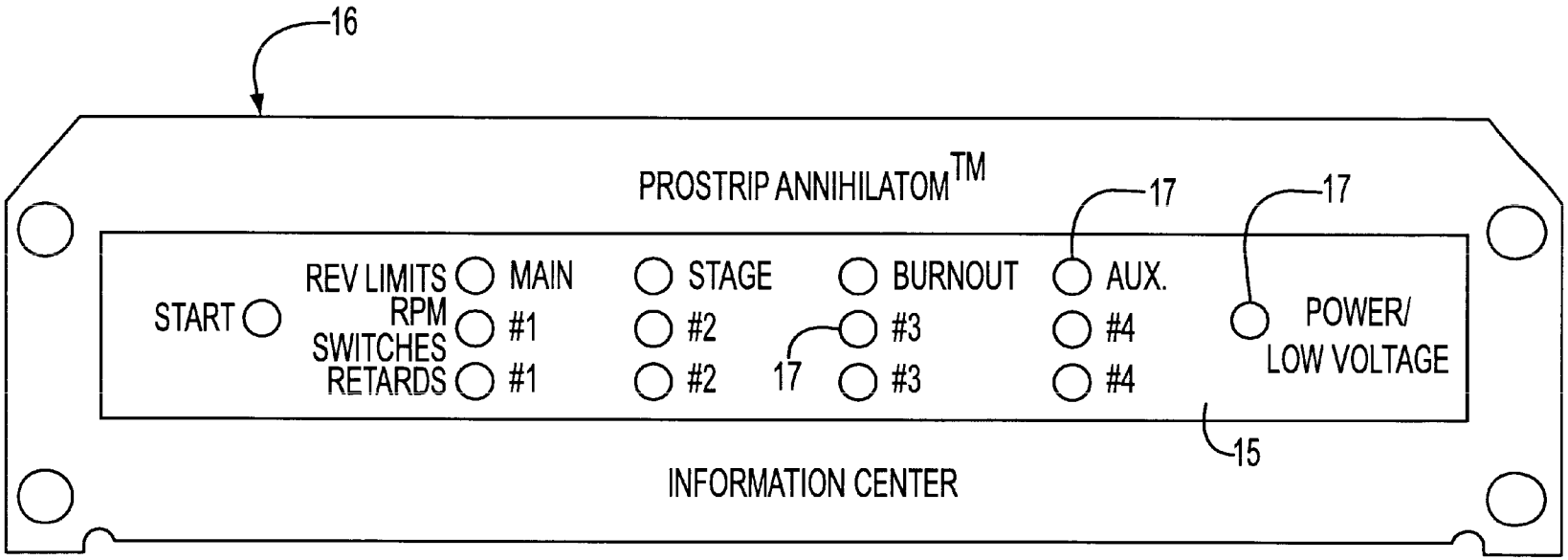
FIG. 3 shows a front elevation view of the control module of the ignition system of FIG. 1.

Referring in particular to FIGS. 1 through 3, the control module 16 incorporates the microcontroller 20, which has a processor and a memory, while the high voltage unit 18 incorporates power output circuitry including a storage, or "bathtub" capacitor 22. The control module 16 utilizes a timing signal generated by an engine speed indicator device, such as a magnetic reluctor, high energy ignition (HEI), or breaker points of the engine, and instructs the high voltage unit 18 when to produce a capacitive discharge to be coupled through an ignition coil 100 to spark plugs of an internal combustion engine. The ignition system 10 disclosed can be used with a number of different types of ignition coils. However, the system is preferably used with a Lasershot™ brand ignition coil available from Holley Performance Products of Bowling Green, Ky.

The control module 16 also includes input, output and interface circuits extending from the microcontroller 20. The input circuits include: a switched power input circuit 24 timing signal input circuits 26, retard enabling circuits 28, and rev limiter enabling circuits 30. The output circuits include: a tachometer output circuit 32 and RPM activated switch output circuits 34. The interface circuits include programmer interface circuits 36, which allows the control module 16 to communicate with the remote programmer 12 and/or the starting line input device 14.

The microcontroller 20 monitors the frequency of the engine timing signal and instructs the high voltage unit 18 when to energize the ignition coil 100 based upon user inputs (through the remote programmer 12, the starting line over rev input device 14 and the enabling switches) and a system program code. Although not shown, the microcontroller 20 includes an analog to digital (A/D) converter, a central processing unit (CPU), electronically erasable programmable read only memory (EEPROM) and standby random access memory (SRAM). The microcontroller 20 may comprise a Motorola MC68HC711E9 microcontroller 20 running at 8 MHz, for example. A detailed understanding of components and operating code for the Motorola MC68HC711E9 microcontroller can be found in Technical Summary HC711, available from Motorola Corporation, Motorola Literature Distribution, Phoenix, Ariz., which is incorporated herein by reference.

The microcontroller 20 includes program code instructing the processor to communicate with the remote programmer 12 and/or the input device 14, and use the resulting user inputs with the engine timing signal to calculate the proper time for energizing the ignition coil 100. The program code for the presently disclosed ignition system is contained in U.S. Provisional Patent Application Serial No. 60/063,963, which has been incorporated herein by reference.

Referring to FIG. 1, the control module 16 includes a wiring harness 39. The harness includes: wires 40 for connection to an on/off power switch; wires 42 for connection to a magnetic input from a distributor, i.e., engine timing signal; wires 44 for connection to a remote tachometer; wires 46 for connection to auxiliary vehicle components controlled by the RPM activated sensors; wires 48 for connection to retard enabling switches; wires 50 for connection to rev limiter enabling switches; wires 52 for connection to HEI/points; wires 54 for connection to a Hall Effects sensor; wires 56 for connection to a MAP sensor; wires 58 for connection to temperature or oil pressure sensors for an alarm circuit and an emergency kill circuit of the control module 16; and wires 60 for connection to a wiring harness 92 of the high voltage unit 18. A preferred Hall Effects sensor is disclosed in U.S. Provisional Patent Application Serial No. 60/063,934, which has been incorporated herein by reference.

Although not shown in the block diagram of FIG. 2, the control module 16 also includes a MAP sensor input circuit, a HEI/points input circuit, an alarm input circuit, an emergency kill input circuit, and a Hall Effects sensor input circuit. An electrical schematic of the control module 16 is contained in commonly owned U.S. Provisional Patent Application Serial No. 60/063,963, the disclosure of which has been incorporated herein by reference. As shown in FIG. 3, the control module 16 includes a display board 15 having a plurality of LED indicators 17 for indicating when the system 10 is executing the various functions, such as the rev limiters, RPM switches and timing retards.

Referring to FIGS. 1, 2 and 3, the high voltage unit 18 includes a flip latch circuit 70 that turns on a power transistor circuit 72 whenever the flip latch receives a "begin conduction" signal from the microcontroller 20. When the power transistors 72 are turned on, current is pulled through a primary side of a power transformer 74 and voltage begins to increase across the transformer. Once a sufficient amount of current has been stored on the primary side of the transformer 74, the flip latch 70 turns off the transistors 72 such that current flow stops. The sudden collapse of the current flow through the primary of the transformer 74 transfers the stored energy to a secondary side of the transformer and charges the "bathtub" capacitor 22 through charge diodes 78.

The voltage stored on the capacitor 22 is maintained until the next engine timing signal occurs or enough time has elapsed for the voltage to leak off through an overvoltage circuit 80. The overvoltage circuit 80 is used to prevent tremendous buildups of energy on the bathtub capacitor 22 in the event the ignition coil 100 is disconnected during operation. In addition, the overvoltage circuit 80 causes the flip latch 70 to turn off the transistors 72 in the event the voltage across the bathtub capacitor 22 exceeds an unsafe level.

When the transistors 72 are turned on again by the flip latch 70, in response to a signal from the microcontroller 20, a short voltage pulse is reflected across the transformer 74 and enables a trigger circuit 82, which triggers a silicon controlled rectifier ("SCR") 84, so that the previously stored energy on the bathtub capacitor 22 is gated out to the ignition coil 100 of the motor. The high voltage unit 18 then waits for the next signal from the microcontroller 20 to create another charge.

Thus, the flip latch 70 normally produces a single charge per engine timing signal to the igniton coil 100 such that the ignition coil provides voltage for a single spark. The microcontroller 20 produces additional sparks, i.e., restrikes, by signaling the flip latch circuit 70 multiple times between engine timing signals, and prevents sparking, i.e., rev limiter, by turning off the transistors 72 through an end conduction circuit.

The high voltage unit 18 also includes a power circuit 88 which connects to a vehicle battery 90, and distributes power to the transformer 74, through the high voltage unit 18 to the control module 16 and, through the control module 16 to the user input device 14 and the remote programmer 12. The wiring harness 92 of the high voltage unit 18 includes wires 94 for connection to the wiring harness 39 of the control module 16, wires 96 for connection to the vehicle battery 90, and wires 98 for connection to the vehicle ignition coil 100.

Remote Programmer

Figure 4:
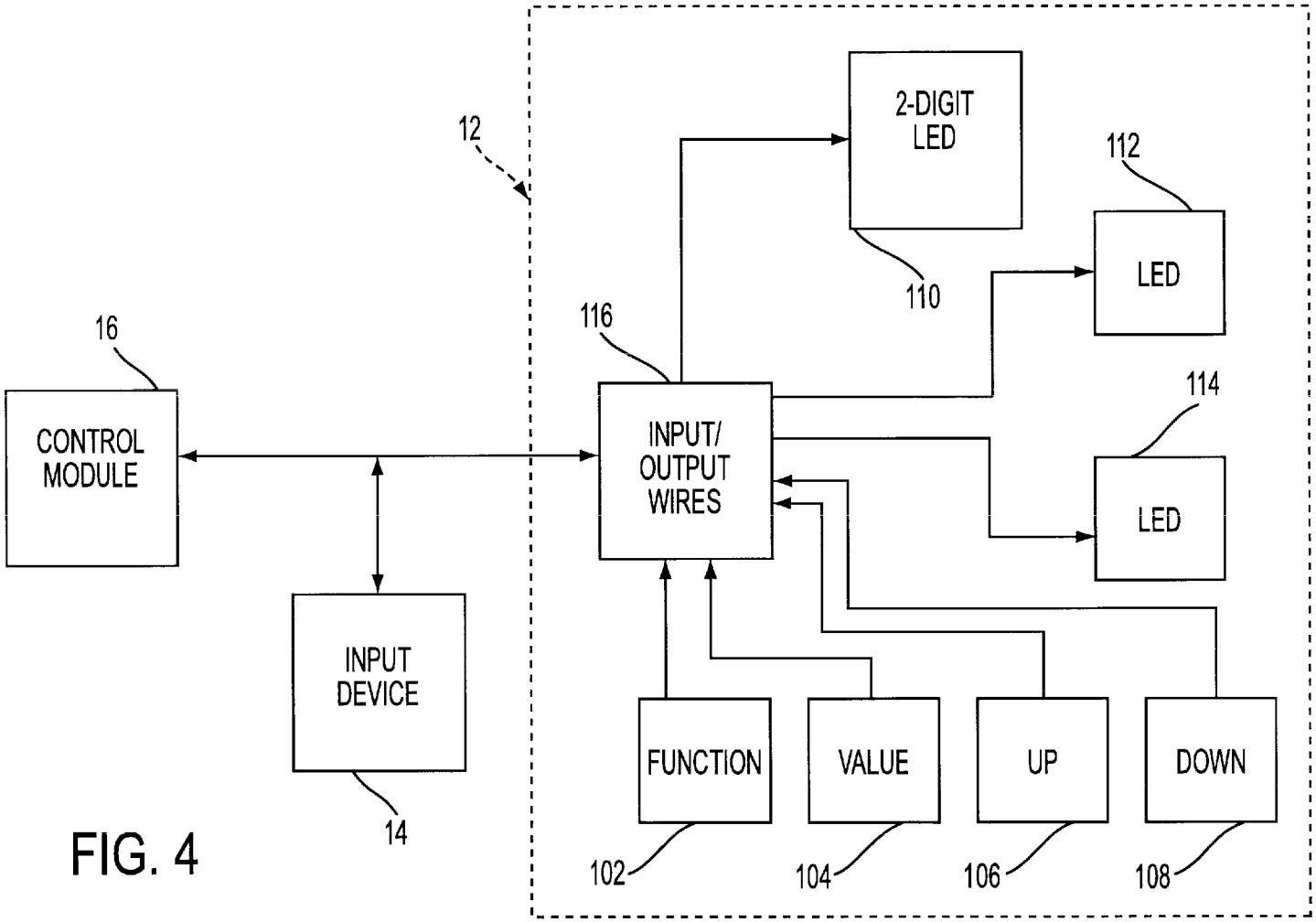
FIG. 4 shows a hardware diagram of a remote programmer of the ignition system of FIG. 1.

Referring to FIGS. 1 and 4, the remote programmer 12 operates as an interface between the user and the control module 16 to facilitate changes to system function values. The programmer 12 allows the user to access and change system function values stored in the EEPROM of the microcontroller 20 of the control module 16. The programmer 12 has a function, a value and at least one scroll switch. Preferably, the programmer 12 has a membrane switch overlay with four switches 102, 104, 106, 108 corresponding to "FUNCTON", "VALUE", "UP" and "DOWN". The overlay also has a red/transparent window through which a two, seven-segment LED display 110 may be viewed. Two LED indicators 112, 114 corresponding to the FUNCTION and the VALUE switches 102, 104 are also provided, preferably in different colors.

The FUNCTON switch 102 allows access to memory indices of the EEPROM corrsponing to different system functions, and the VALUE switch 104 allows access to memory locations contained within the various indices themselves, wherein the memory locations correspond to different possible values for each system function. The UP and DOWN switches 106, 108 allow a user to scroll between the indices when in the FUNCTON mode, or the indices' discrete memory locations when in the VALUE mode.

The programmer 12 is adapted to commnunicate with the microcontroller 20. In particular, the various inputs and outputs of the programmer 12 are routed to the control module 16 via a cable 116. Power is supplied to the programmer 12 from the control module 16 via the cable 116. An electrical schematic of the programmer 12 is contained in commonly owned U.S. Provisional Patent Application Serial No. 60/063,963, the disclosure of which has been incorporated herein by reference.

Figure 5:
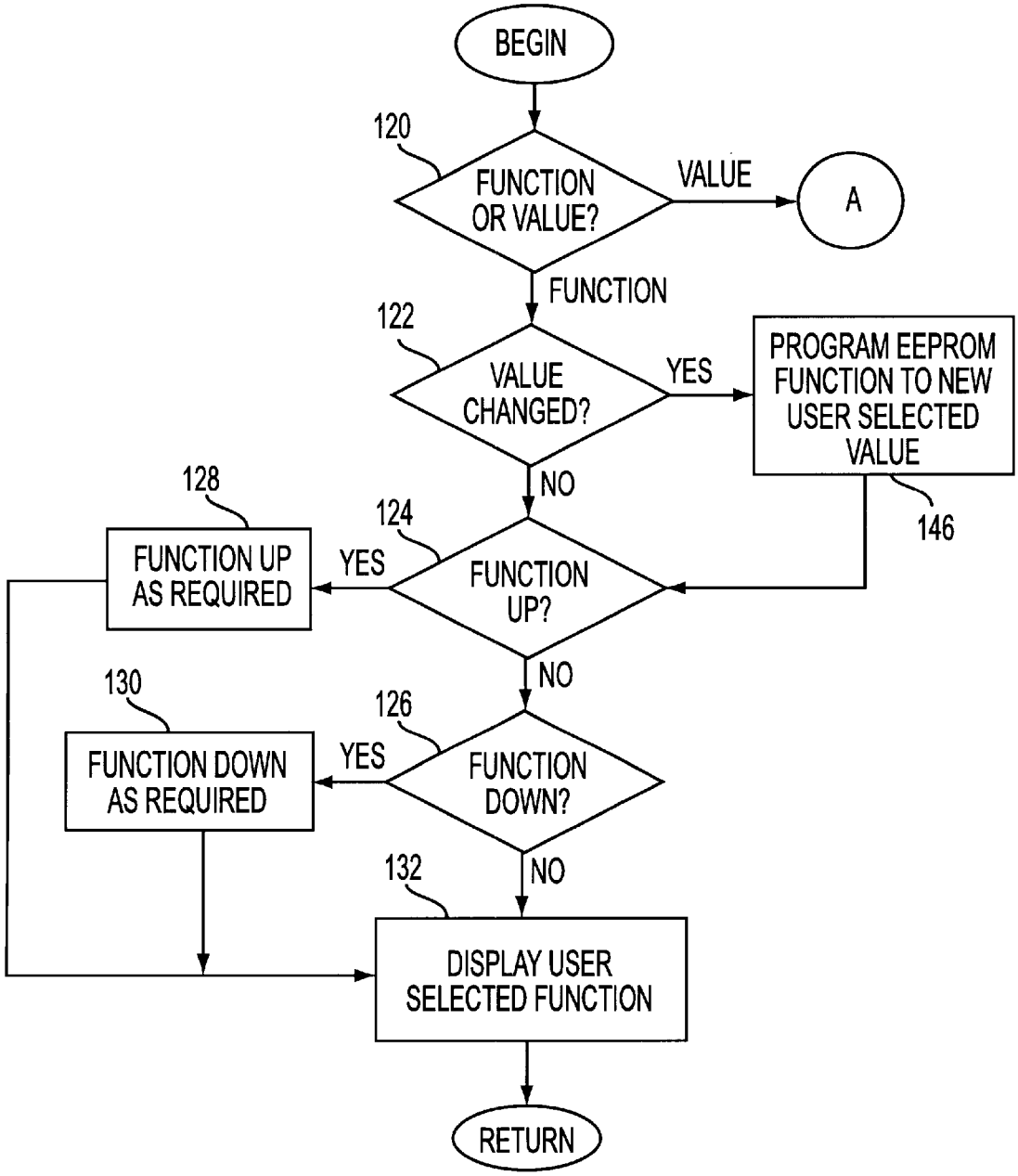
FIGS. 5 and 6 show a flow chart of a method for changing function values in response to user inputs through the remote programmer of the ignition system of FIG. 1.
Figure 6:
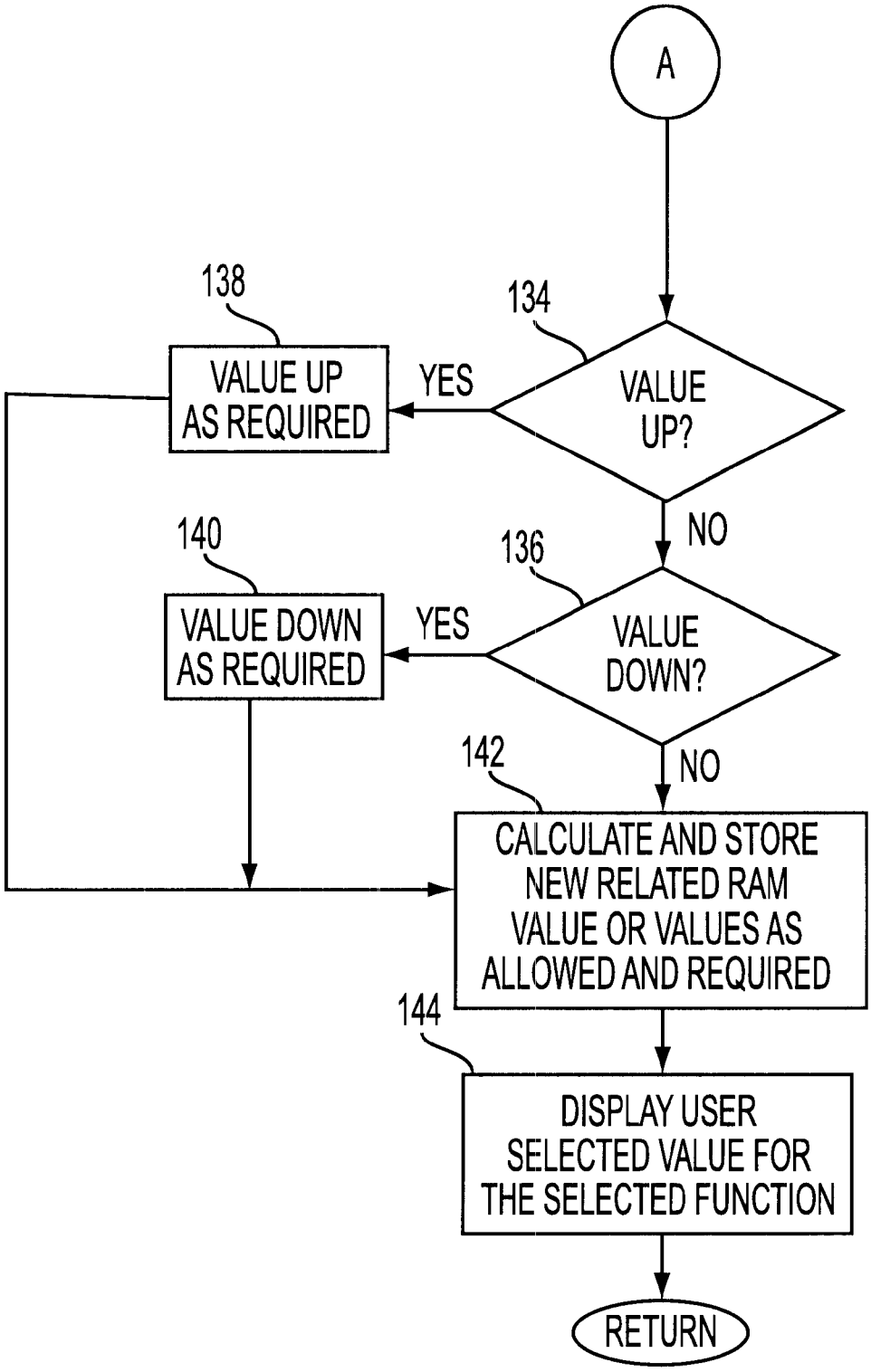

Referring also to FIGS. 5 and 6, a process for changing the system function values stored in system function indices of the ignition system microcontroller 20 in response to user inputs through the remote programmer 12 is shown. Referring first to FIG. 5, the process includes, at 120, monitoring the function and the value switches 102, 104 of the programmer 12. If the function switch 102 is selected, and the value has not been changed at 122, the microcontroller scans the scroll, i.e.,up and down switches 106, 108. If one of the scroll switches 106, 108 is selected by a user, at 124 and 126, the microcontroller 20 moves the function up or down as required at 128, 130. If neither scroll switch 106, 108 is selected, or if one of the scroll switches has been selected and the function has been moved up or down, the resulting function is displayed at 132.

If the value switch 104 is selected, at 120, the microcontroller 20 scans the scroll switches 106, 108. If one of the scroll switches 106, 108 is selected by a user, at 134, 136 of FIG. 6, the microcontroller 20 moves the value up or down as required at 138, 140. If neither scroll switch 106, 108 is selected, or if one of the scroll switches has been selected and the function has been moved up or down, at 142 the resulting value is used to calculate and store new related RAM value or values as allowed and required by the system program code. The resulting value is then displayed, at 144. If the function switch 102 is selected again, at 120 of FIG. 5, the microcontroller 20 saves the new value of the last displayed function code into the programmable read only memory of the microcontroller, at 146.

Thus, an operational ignition system can include the high voltage unit 18, the control module 16 and the remote programmer 12, i.e, the system does not require the starting line input device 14. Preferably, the high voltage unit 18 is mounted in an engine compartment of a vehicle, while the control module 16 and the remote programmer 12 are mounted in a passenger compartment of the vehicle. The system, however, can also include the starting line rev limiter input device 14.

Starting Line Rev Limiter Input Device

Figure 7:
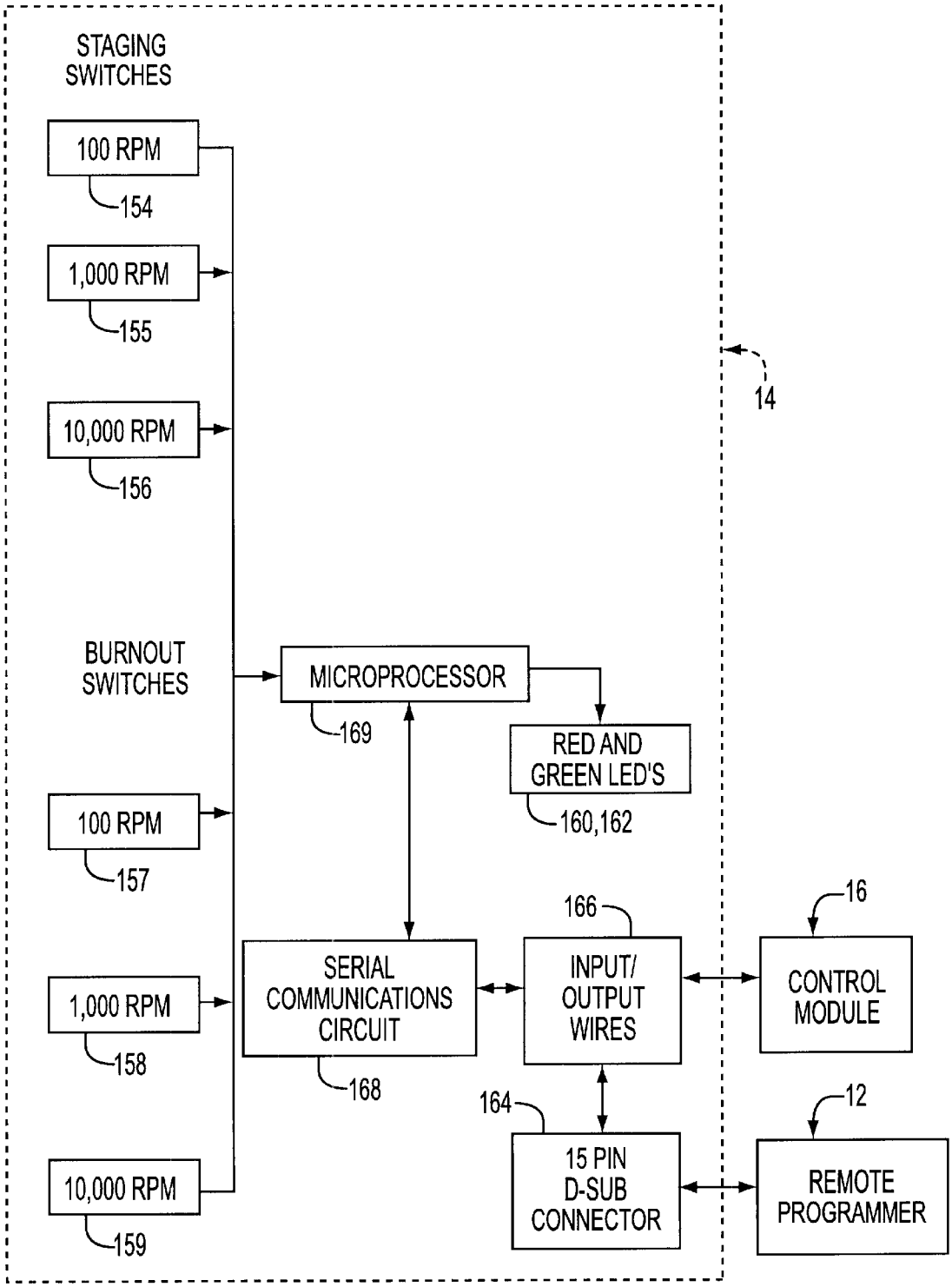
FIG. 7 shows a hardware diagram of a starting line input device of the ignition system of FIG. 1.
Figure 8:
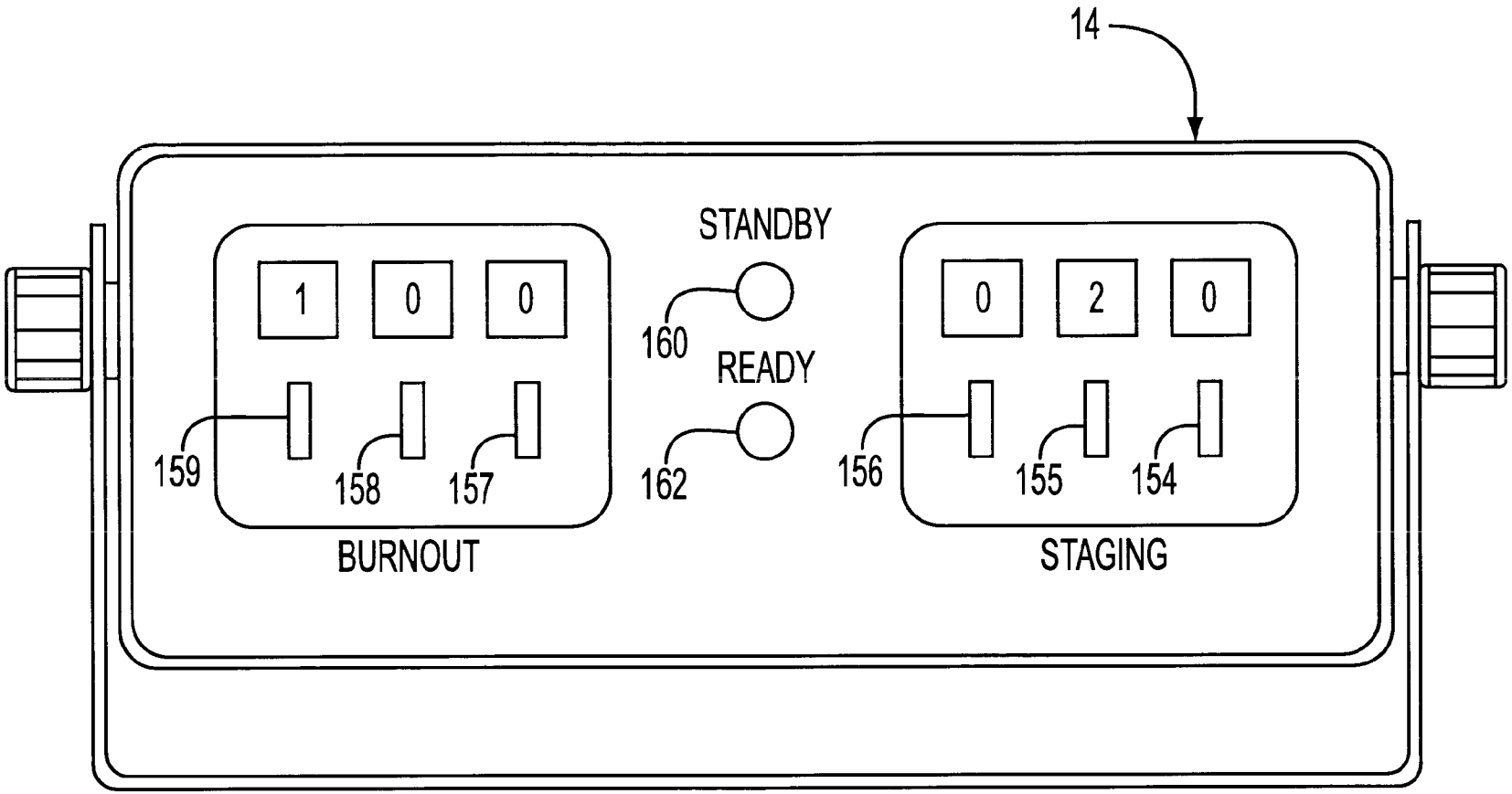
FIG. 8 shows a front elevation view of the starting line input device of the ignition system of FIG. 1.

Referring to FIGS. 1, 7 and 8, The starting line rev limiter input device 14 operates as an interface between the user and the control module 16 to facilitate rapid changes to the "staging" and "burnout" engine speed limiter function values contained in the EEPROM of the microcontroller 20 of the control module. The input device 14 utilizes its own microcontroller 169 to process user inputs through switches 154–159, convert the user input into usable codes for the control module 16, and communicate the usable codes to the control module. It should be understood that the system 10 can include just the input device 14, without the remote programmer 12, or can include both the remote programmer and the input device, or just the remote programmer without the input device.

Referring in particular to FIG. 8, the switches 154–159 of the input device 14 comprise two sets of three rotary, push-button-style binary-coded decimal (BCD) switches for user input. The switches are of a non-complementary style. One set of switches 154–156 is labeled "STAGING" and the other set of switches 157–159 is labeled "BURNOUT". Two different colored LED indicators 160, 162 protrude from the input device 14, with one indicator preferably labeled "STANDBY" and the other indicator labeled "READY".

When the input device 14 is incorporated into the system 10, the input device connects to the control module 16, while the programmer 12 connects to the input device 14. The input device 14 includes a male connector 164 for connection to the female connector 116 of the programmer 12, and a female connector 166 for connecting to the male connector 167 of the control module 16. The input device 14 communicates with the control module 16 via a serial communications circuit 168. The programmer 12 communicates directly with the control module 16, but the control module is programmed such that the input device 14 will override any burnout and staging information programmed into the control module from the programmer. The programmer 12, when attached to the input device 14, will display the updated system function values from the control module 16 for staging and burnout settings as entered through the input device.

The switches 154–159 relate to either 100, 1,000 or 10,000 so that a range of 0–16,000 rpm in 100 rpm increments can be achieved. If a value greater than a maximum allowed rev limiter value, e.g., 16,000 rpm, is selected, the microcontroller 169 is programmed to send a value of 16,000 to the control module. The microcontroller 169 of the input device 14 can comprise a Microchip PIC16C73A running at 4 MHz, for example. An electrical schematic of the input device is contained in commonly owned U.S. Provisional Patent Application Serial No. 60/063,962, the disclosure of which has been incorporated herein by reference.

Figure 9:
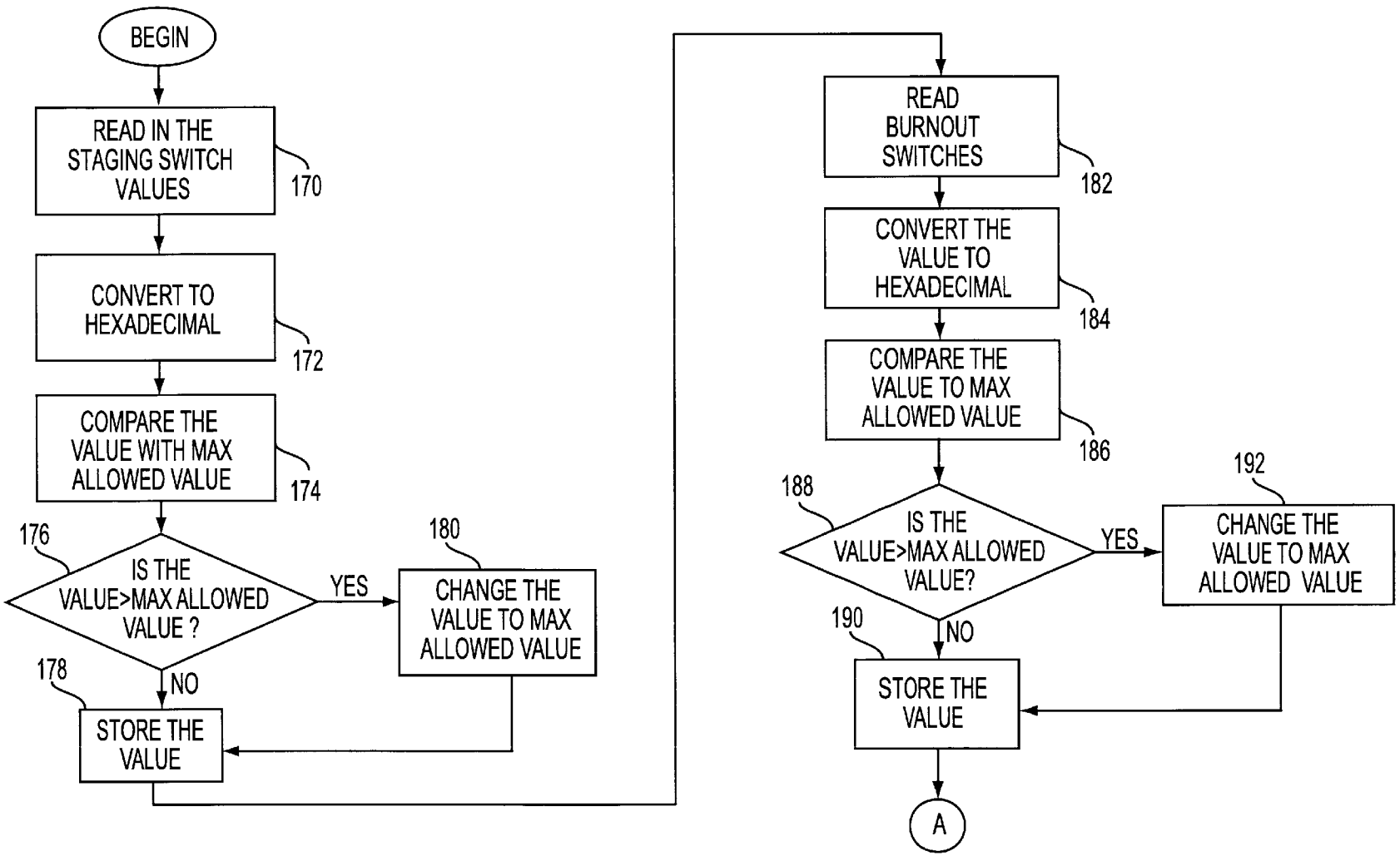
FIGS. 9 and 10 show a flow chart of a method for changing function values in response to user inputs through the starting line input device of the ignition system of FIG. 1.
Figure 10A:
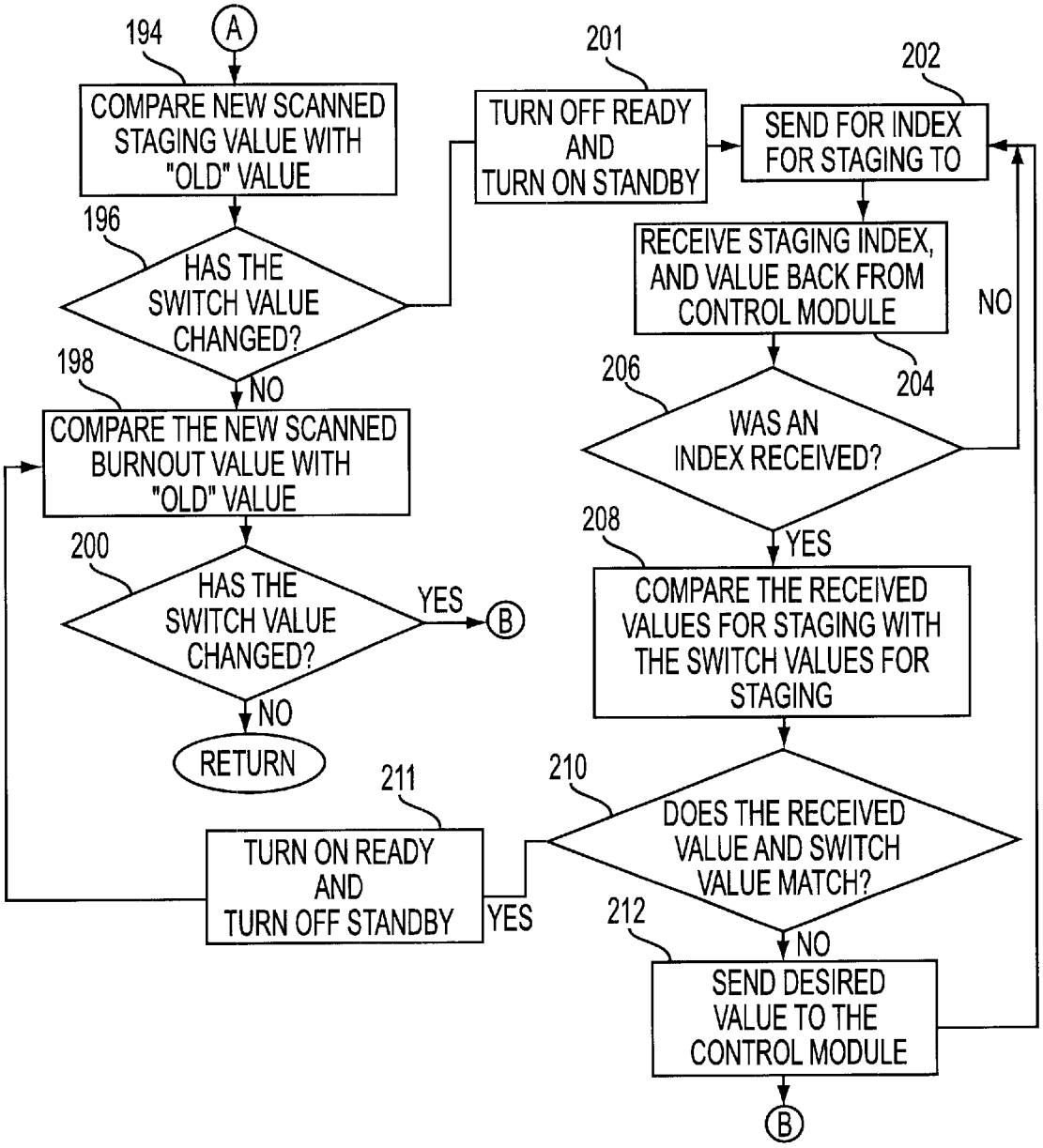
Figure 10B:
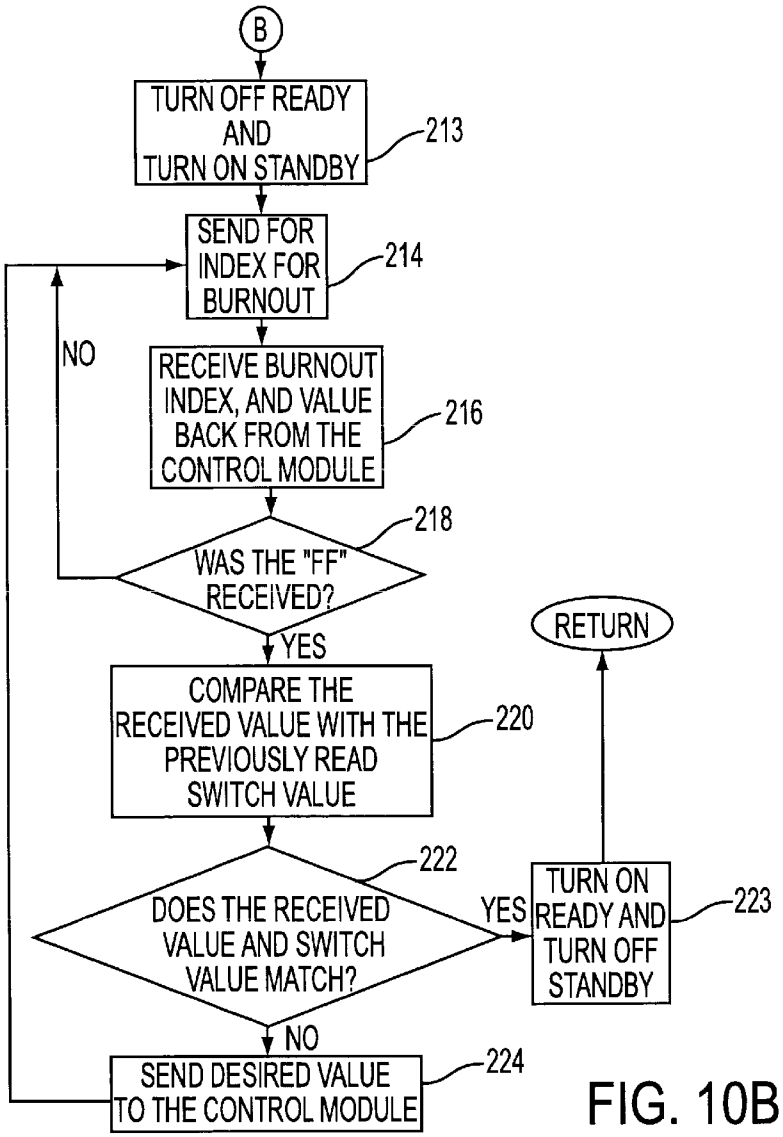
Figure 11A:
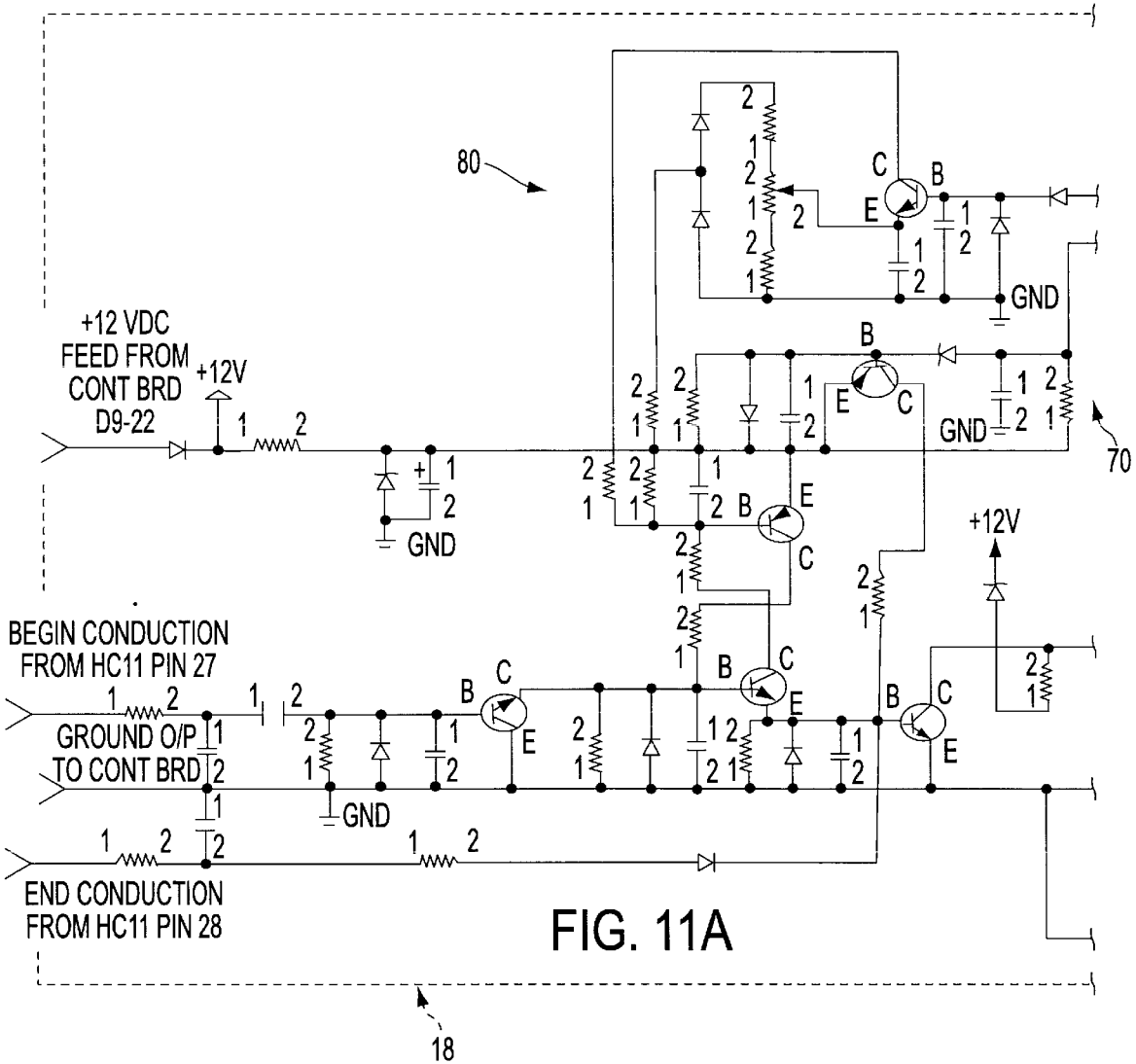
FIG. 11 shows an electrical schematic of the high voltage module of the ignition system of FIG. 1.
Figure 11B:
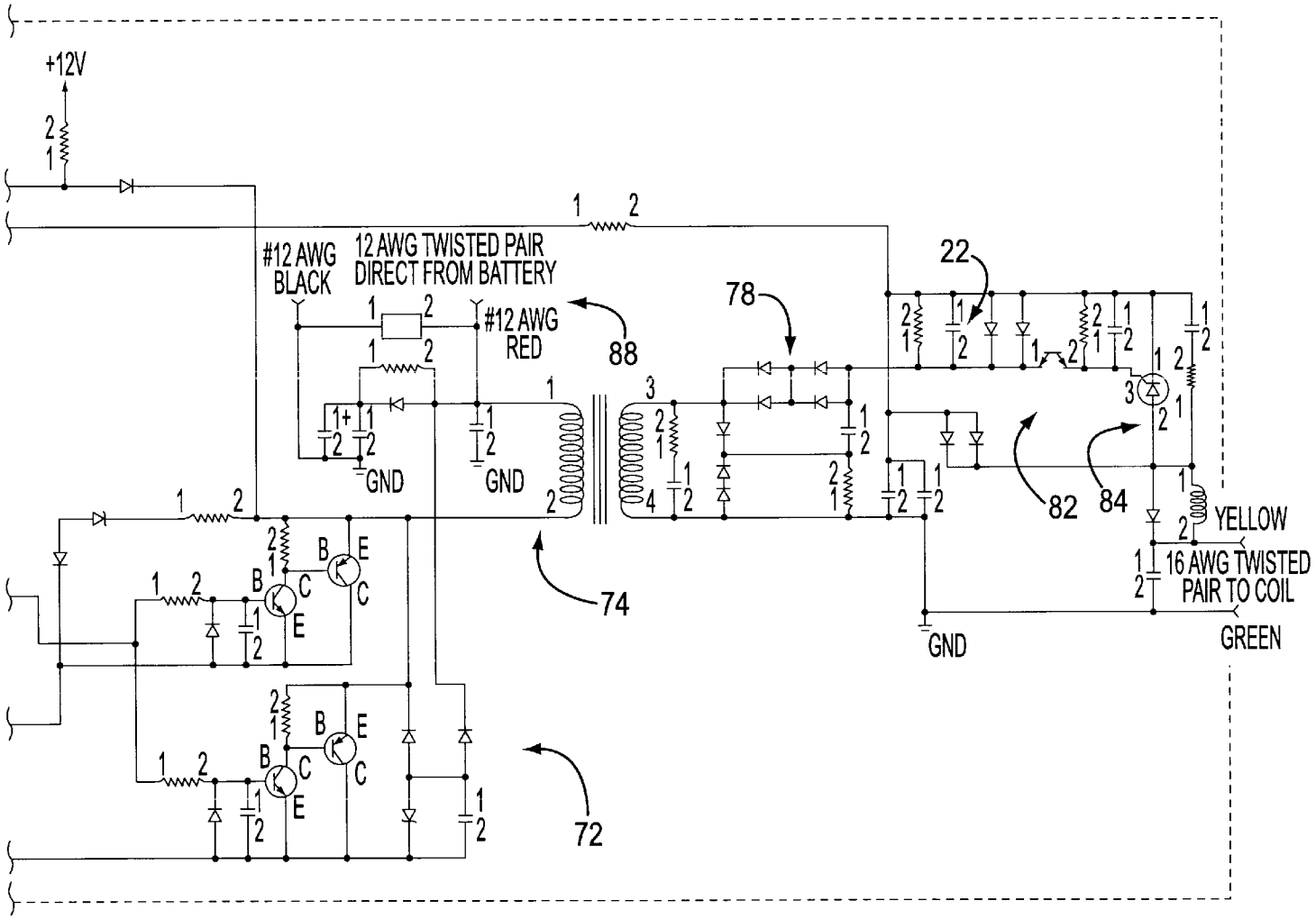

FIGS. 9 and 10 show a process for changing values of the staging and the burnout speed limiter features stored in the EEPROM of the control module 16 as carried out bad the microcontroller 169 of the starting line input device 14 in response to user inputs through the input device 14. Referring to FIG. 9, the process begins at 170 when the staging switches' 154–156 value is read. The switches' 154–156 value is then converted to hexadecimal at 172, and compared with a maximum allowed rev limiter at 174. If the switches' 154–156 value is less than the maximum allowable rev limiter value, at 176, then the switches' value is stored, at 178, in a memory of the microcontroller 169 of the inputs device 14. If the switches' value is greater than the maximum allowable rev limiter, at 176, then the staging switches' value is changed to the maximum allowable value, e.g., 16,000 rpm, at 180, and then stored, at 178. The same process is repeated for the burnout switches 157–159 at 182 through 192.

Referring to FIG. 10, at 194, the "newly" stored staging switches' 154–156 value is compared with a previously stored "old" staging switches' value. If the old and the new staging values are equal, i.e., if there has not been a change to the staging switches 154–156, at 196, the "newly" stored burnout switches' 157–159 value is compared with a previously stored "old" burnout switches' value, at 198. If the old and the new burnout values are equal, i.e., if there has not been a change to the burnout switches 157–159, at 200, the process is started over.

If the staging switches 154–156 are found to have changed, at 196, then the microcontroller 169 first turns the ready LED 162 off and turns the standby LED 160 on, at 201. At 202 and 204, the microcontroller 169 "asks" the control module 16 for, and receives back the currently stored value for the staging rev limiter feature. If a value is not received back, at 206, the microcontroller 169 repeats until a response is received back from the control module 16. If a value is received back, at 206, then the microcontroller 169 compares the staging value from the control module 16 with the newly entered staging switches' 154–156 value at 208. If the staging value from the control module 16 equals the newly entered staging switches' 154–156 value, at 210, then the ready LED 162 is turned on and the standby LED 160 is turned off, at 211. If, however, the staging value from the control module 16 does not equal the newly entered staging switches' 154–156 value at 210, then the microcontroller 169 of the input device 14 instructs the microcontroller 2(l of the control module 16 to replace the staging value currently saved in EEPROM with the newly entered staging switches' 154–156,value, at 212. If the burnout switches 157–159 are found to have changed, at 200, then the microcontroller 20 repeats the same process for the burnout values, at 213 through 224.

The principles, preferred embodiments and modes of operation of the presently disclosed ignition system has been described in the foregoing specification. The presently disclosed ignition system, however, is not to be construed as limited to the particular embodiment shown as this embodiment is regarded as illustrious rather than restrictive. Moreover, variations and changes may be made by those skilled in the art without departing from the spirit of the presently disclosed ignition system as set forth by the following claims.

What is claimed is:

1. A process for changing values stored in function indices within a memory in an ignition system in response to user input through a remote programmer having function, value and scroll switches and a display, the function indices accessed by the ignition system to control engine ignition, comprising:

displaying a function code by selecting the function switch;

displaying a different function code by selecting the scroll switch;

displaying a value by selecting the value switch;

displaying a different value by selecting the scroll switch; and saving the different value for the last displayed function code into the memory.

2. The process of claim 1, wherein said step of saving results from selecting the function switch.

3. The process of claim 1, wherein the remote programmer is located inside a vehicle.

4. The process of claim 1, wherein the remote programmer comprises at least one indicator for indicating when one or more of the function switch and the value switch is selected.

5. The process of claim 4, wherein said at least one indicator comprises a light emitting diode.

6. The process of claim 1, wherein the system function indices comprise at least one rev limiter.

7. The process of claim 1, wherein the system function indices comprise at least two of:

(a) a main rev limiter; (b) a staging rev limiter; (c) a burnout rev limiter; and (d) an auxiliary rev limiter.

8. The process of claim 6, wherein said step of saving results in the reprogramming of a value for the rev limiter.

9. The process of claim 6, wherein said step of saving results in the reprogramming of the misfire pattern for the rev limiter.

10. The process of claim 1, wherein the system function indices comprise at least one timing retard.

11. The process of claim 1, wherein the system function indices comprise at least two timing retards, each of said timing retards being separately programmable in degrees of spark timing.

12. The process of claim 1, wherein the system function indices comprise at least one engine speed activated switch.

13. The process of claim 1, wherein the system function indices comprise a timing curve.

14. The process of claim 13, wherein said step of saving permits the reprogramming of multiple points of said timing curve as function of engine speed.

15. The process of claim 1, wherein the system function indices comprise a boost retard for retarding ignition timing based on boost pressure.

16. A process for changing a value stored for a system function index of a memory in an ignition system in response to user input to an input unit having a switch and a first indicator, the function index accessed by the ignition system to control engine ignition, comprising:

scanning the switch for a user input value corresponding to the system function index;

accessing the memory to retrieve a previously stored value for said system function index;

comparing the scanned value to the accessed value;

turning on the first indicator if the scanned value and the accessed value are not the same; and storing the scanned value into the memory.

17. The process of claim 16, wherein said input unit includes a second indicator, and further comprising the step of turning on the second indicator and turning off the first indicator.

18. The process of claim 16, wherein the scanned value is converted to a machine readable value.

19. The process of claim 16, further comprising the steps of:

comparing the scanned value to a maximum allowed value;

using the maximum allowed value in place of the scanned value if the scanned value is greater than the maximum allowed value.

20. The process of claim 16, wherein the input device is adapted for use with a remote programmer, said input device capable of overriding the remote programmer.

21. The process of claim 16, wherein the system function index corresponds to a rev limiter.

22. The process of claim 16, wherein said switch is a binary-coded decimal switch.

* * * * *